United States Patent [19]

Miller

[11] 4,349,768

[45] Sep. 14, 1982

[54] METHOD FOR STARTING AND OPERATING A PREHEAT TYPE FLUORESCENT LAMP

[75] Inventor: Jack V. Miller, Sierra Madre, Calif.

[73] Assignee: Creators, Inc., Chicago, Ill.

[21] Appl. No.: 163,067

[22] Filed: Jun. 26, 1980

[51] Int. Cl.[3] ..... H05B 41/18; H05B 41/40

[52] U.S. Cl. ..... 315/105; 315/54; 315/62; 315/284; 315/291; 315/283; 315/DIG. 4; 315/DIG. 5

[58] Field of Search ..... 315/99, 100, 105, 276, 315/283, 284, 311, DIG. 5, 54, 62, 291, DIG. 4

[56] References Cited

U.S. PATENT DOCUMENTS 3,924,155 12/1975 Vogeli ..... 315/105 X

*Primary Examiner*—Eugene La Roche

[57] ABSTRACT

A method for starting and operating a preheat type fluorescent lamp includes a source of alternating current, a fluorescent lamp having a low impedance starting mode wherein current passes through one or more starting filaments and a high impedance operating mode wherein current passes through the length of the lamp, a starting switch directing current through the starting filaments in the lamp starting mode, and an inductor ballast having a magnetically permeable core operating in a saturated condition when the lamp is in the low impedance starting mode and in a non-saturated condition when the lamp is in the high impedance operating mode.

7 Claims, 8 Drawing Figures

METHOD FOR STARTING AND OPERATING A PREHEAT TYPE FLUORESCENT LAMP

BACKGROUND OF THE INVENTION

This invention relates to fluorescent lamp circuits of the preheat type which employ starting filaments and in which lamp operating current is controlled by an inductor ballast. Such lamp circuits are commonly used, and are achieving increased use as replacements for the less energy efficient incandescent light bulbs in residential lighting fixtures, portable lamps and fluorescent lampholder fittings, such as those exemplified by my U.S. Pat. No. 4,161,020.

In such residential applications it is very desireable that lamps start quickly and positively. However, currently used preheat inductor ballasts do not start quickly, but instead go through a series of flickering attempts to start before normal lamp operation is achieved. In a typical starting cycle the starting switch may operate from five to ten cycles before current flow through the lamp is established and the lamp is in a normal running mode. Further, where energy consumption is important, it is common practice to produce "energy saving ballasts" which operated the lamp at less than rated current, further degrading the starting characteristics of the lamp. The operating lifetime of fluorescent lamps is based to a great extent on the number of starts involved. Although the lamp manufacturers rate lamps in terms of hours of operation, the standard includes the number of hours per start. In typically used residential lamps, such as the 22-watt circline lamp rated for 12,000 hours at 3½ hours per start, the effective lamp life is actually 3,428 starts or approximately 10 years of daily use. However, if the ballast design permits the starter to attempt to start the lamp five times before normal running is achieved, the real lamp life is only 2 years.

Similarly, the lamp starter is rated for 6,000 starts to be rated as certifiable quality. This would represent 16 years of daily use, but it is well known that the starter is the most likely component to fail in a preheat lamp circuit. In this case also, each attempted start must be included to obtain the real expected starter life, which is usually no more than three years.

The function of the fluorescent ballast is simply to limit the current flow through the lamp to prevent the lamp current from the thermal runaway in which the lamp would destroy itself. A specific lamp may be operated over a wide range of lumen output by varying the current limiting of the ballast. Therefore ballasts have become available which may vary ±20% from the rated lamp current, and which also have respective proportional starting currents. Fluorescent ballast designers have in the past been very careful to avoid inductor core saturation for both the starting and running modes of preheat type inductor ballasts. Therefore the higher running current ballasts have higher starting current, and tend to start more quickly. Conversely, the lower running current ballasts which are attractive as energy conservation devices, also have lower starting current with the attendant slow, flickering starts.

One application where reduced lamp brightness is needed is in multi-level lighting circuits, such as the three-way brightness circuit shown in my U.S. Pat. No. 4,178,535. It is mandatory in this type of application that the start be immediate, even if the circuit is in the low brightness mode, particularly since the first position of a three-way switch is always the low position. The use of presently known ballasts is not possible where the low brightness mode is 50% to 60% of full rated lamp current and lumen output, because the ballast will not provide sufficient starting current.

The inability of preheat inductor ballasts to start fluorescent lamps at low temperatures is well known in the lighting industry. Specifications for such ballasts limit operation to temperatures above 40° Fahrenheit, with some manufacturers limited to above 50° Fahrenheit. This ballast limitation restricts preheat lamps to indoor use even in moderate climates, and even precludes many indoor uses, such as garages, warehouses, etc.

SUMMARY OF THE INVENTION

This invention concerns a preheat type fluorescent lamp circuit for achieving fast and positive starting under a wide range of operating current and environmental temperatures, and particularly for such applications as lamps which are operated at reduced current and lumen output, such as those lamps employed in residential lighting fixtures, portable lamps and in multi-level applications.

One feature of the invention provides a method for starting and operating a preheat type fluorescent lamp circuit including an inductor ballast of the core-and-coil type in which the inductor core operates in a non-saturated mode during high impedance lamp running with current flow through the ionized gas of the fluorescent lamp tube, and in which the inductor core operates in a saturated mode during low impedance lamp starting with current flow directed through one or more lamp filaments by a starting switch means.

An object of the invention is to provide a preheat fluorescent lamp operating circuit as described in which the starting current is at least 75% greater than the lamp running current, thereby providing fast, reliable starts with little or no flickering.

Another object of the invention is to provide a preheat fluorescent lamp operating circuit as described with the capability of limiting lamp current to as little as 50% of the nominal rated current and brightness, without significant reduction of the lamp starting current and reliability.

Another object of the invention is to provide a preheat fluorescent lamp operating circuit as described and having the ability of starting the lamp at temperatures substantially below zero degrees Fahrenheit.

Another object of the invention is to provide a preheat fluorescent lamp operating circuit as described in which the number of flickering attempts to start, characteristic of preheat lamp circuits, is virtually eliminated; thereby significantly extending the operating life of both the lamp and starter.

To the above ends, the present invention provides a preheat fluorescent lamp operating circuit including a source of alternating current, a fluorescent lamp having a high impedance operating mode wherein current passes through the length of the lamp, a starting switch directing current through starting filaments of the lamp during a low impedance starting mode, and an inductor ballast having a magnetically permeable core operating in a saturated condition when the lamp is in the low impedance starting mode, and in a non-saturated condition when the lamp is in the high impedance operating mode. Extensive testing by the inventor has shown that an embodiment as described reliably starts a preheat type lamp with little or no flickering at a starting current at least 75% greater than the lamp running current. Another embodiment has demonstrated the capability of starting the lamp acceptably and operating the lamp at as little as 50% of nominal lamp current. Low temperature testing of circuits in accordance with the invention has shown that the saturation starting mode employed in the ballast will reliably start preheat lamps as cold as −30° Fahrenheit, at least 70° colder than the lower limit for prior art ballasts. Life testing of circuits in accordance with the invention has shown the operating life of both lamps and starters to be 70,000 starts, equivalent to 190 years of daily use, more than ten times the rated life of the starters and more than twenty times the rated life of the lamps when used with prior art ballasts.

DESCRIPTION OF THE PREFERRED EMBODIMENT

Figure 1:
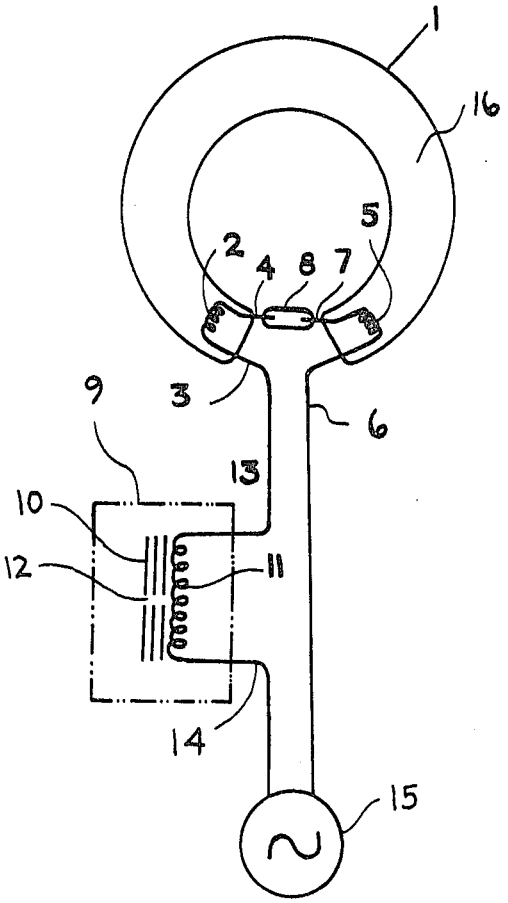
FIG. 1 is an electrical schematic diagram of the circuit for operating a preheat type fluorescent lamp employing a saturation starting ballast.

In FIG. 1 a circuit arrangement and method for starting and operating a preheat type fluorescent lamp is shown having a fluorescent lamp 1, shown as a circline lamp but exemplary of any lamp shape, having a first filament 2 which is provided with a first connection lead 3 and a second connection lead 4, and a second filament 5 which is provided with a first connection lead 6 and a second connection lead 7. A starting switch means 8 is connected between lead 4 and filament lead 7. A core-and-coil inductor ballast 9 is provided with a magnetically permeable core 10 and a current carrying coil 11. The core 10 is provided with at least one non-magnetic gap 12 of appropriate width to alter the permeability of the core 10. Coil 11 has a first lead 13 connected to filament lead 3, and a second lead 14 connected to an alternating current power source 15. Filament lead 6 is also connected to power source 15, closing the circuit path.

In operation, alternating current from the power source 15 is passed through coil 11, inducing a magnetic field in core 10, and thereby causing the ballast 9 to limit current flow. Under starting conditions current flows from ballast 9 through the first lamp filament 2, through starter means 8, through filament 5 and back to power source 15. The impedance in the starting mode includes the impedance of the ballast 9 and filaments 2 and 5, providing a relatively low impedance path and resulting in relatively high current flow through the circuit. The permeability of core 10 in accordance with my invention is selected compatibly with the magnetizing force of coil 11 so that under the low impedance conditions of starting core 10 is substantially in magnetic saturation to the extent that current flow is limited substantially by the electrical resistance of coil 11 in series with lamp filaments 2 and 5. As the filaments have increased resistance with increasing temperature, filaments 2 and 5 become incandescent and ionize a metallic vapor 16 in lamp 1. As the resistance through lamp vapor 16 is reduced through ionization to a point lower than the resistance of starting switch 8, switch 8 ceases to conduct and the current path goes through the lamp vapor only, thereby converting the circuit from the relatively low impedance starting mode to the relatively high impedance operating mode. The current is reduced by the change from the low impedance path through the filaments 2 and 5 and starting switch 8 to the high impedance path through the lamp vapor 16, reducing the current through ballast coil 11. As the current through coil 11 is reduced, the reduction in magnetizing force reduces the induction of core 10 to a point below saturation level, thereby establishing the ballast 9 as the principal current limiting means for the circuit.

Figure 2:
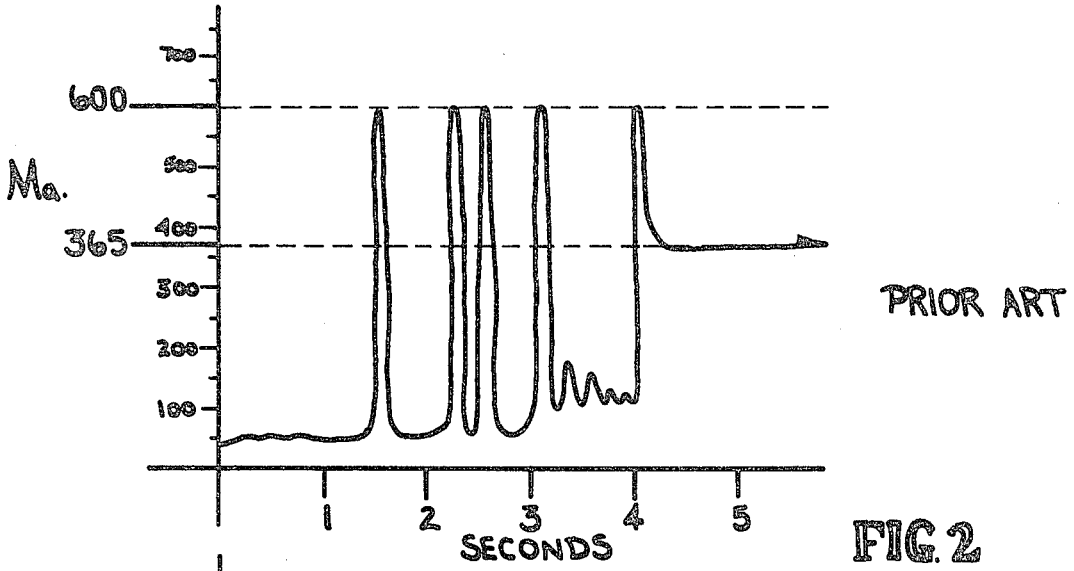
FIG. 2 is a graphical representation showing the starting and operating current versus time for a typical prior art ballast in a preheat lamp circuit.
Figure 3:
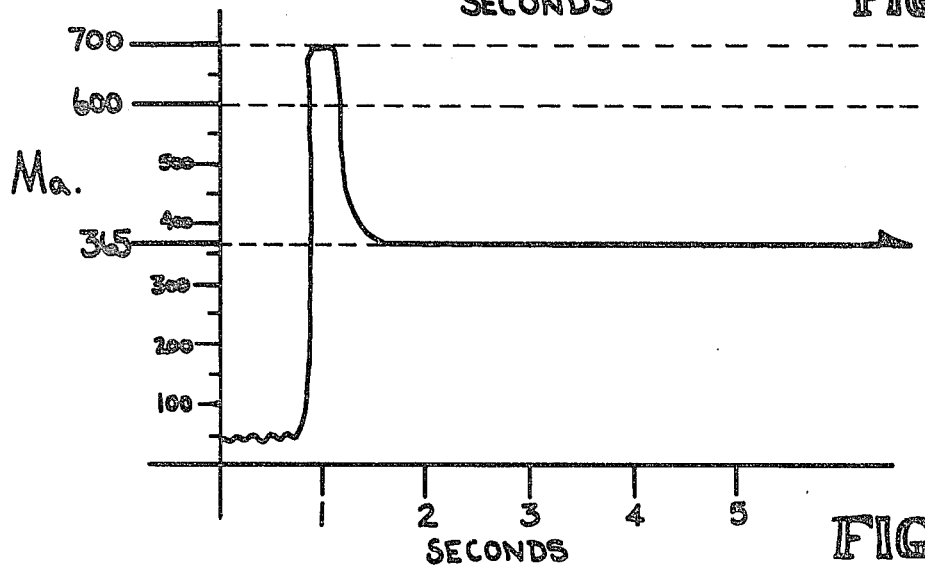
FIG. 3 is a graphical representation showing the starting and operating current versus time for the circuit of FIG. 1.

In FIG. 2 a trace of a typical prior art circuit is shown. The data illustrated is for a nominal 22-watt circline lamp using a conventional inductor ballast not providing the saturation starting mode, and represents starting characteristics typical of the presently available ballasts. When the lamp circuit is energized current flow of approximately 50 Ma continues for approximately 1½ seconds before the first start pulse occurs. Then a series of several additional starting pulses are produced in the next 1 to 3 seconds, with peaks of approximately 600 Ma and low levels of from 50 to 200 Ma in between, as the lamp is partially lighted. At about the fourth second a final pulse of 600 Ma lights the lamp and running continues at the rated lamp current of approximately 365 Ma. The data shown is typical of good quality ballasts rated for nominal lamp current. Some higher running current ballast start within 2 to 3 seconds and have only 2 to 4 false start pulses before ignition. Conversely, many nominal or below nominal current ballasts may require from 5 to 10 seconds to start, and may produce 10 to 20 false start pulses, and such devices are widely marketed and commonly used.

In FIG. 2 a trace of a typical saturation start circuit is shown. The data is also for a nominal 22 watt circline lamp which is popular for residential applications. When the lamp circuit is energized current flow of approximately 30 Ma continues for 1 second or less. As soon as flow through the filaments at about 700 Ma occurs, the lamp ignites within the next ½ second and continues to operate at approximately 365 Ma. Visible flickering is not evident in the starting process.

Figure 4:
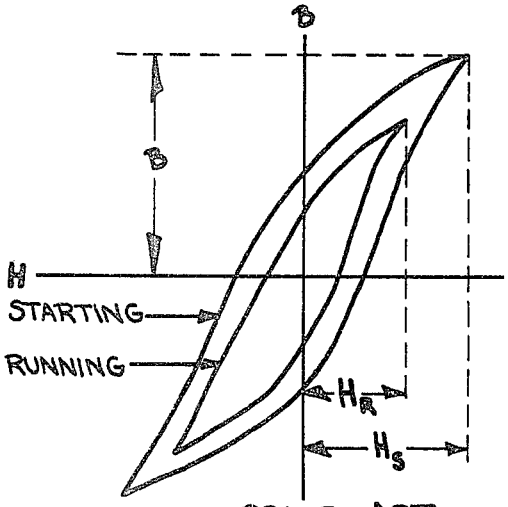
FIG. 4 PRIOR ART
FIG. 4 is a graphical representation showing the magnetic permeability versus magnetizing force for the core of a typical prior art ballast.

In FIG. 4 the BH curve for the core material as used in prior art ballasts is shown. It has two hysteresis loops, a smaller loop representing normal lamp running current passing through the magnetizing coil, and a larger loop representing starting current passing through the magnetizing coil, with both loops formed generally within the substantially linear region of permeability for the ballast core, with H proportional to B values.

Figure 5:
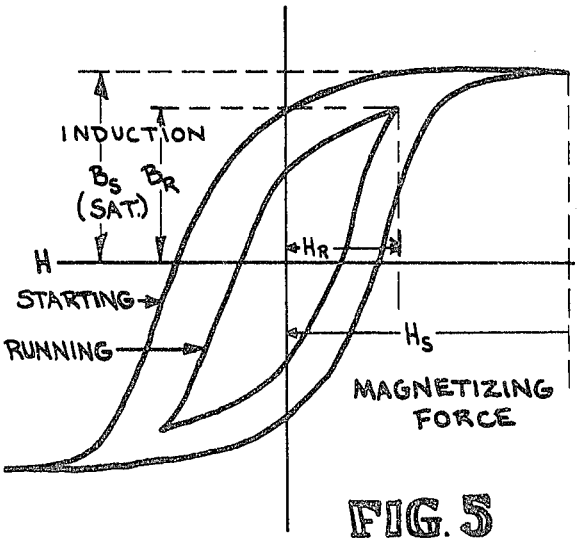
FIG. 5 is a graphical representation showing the magnetic permeability versus magnetizing force for the core of the saturation starting mode for the ballast of FIG. 1.

FIG. 5 shows the BH curve for the core material used in ballasts for the present invention. There are two hysteresis loops, a smaller loop representing lamp running current passing through the magnetizing coil, and a larger loop representing starting current passing through the magnetizing coil. The lamp running current provides a hysteresis loop which is within the substantially linear region of permeability for the ballast core. However, the starting current generates a hysteresis loop of saturated form, where further increases in magnetizing force H produces no further induction B. Current flow is at that point no longer controlled by inductance, but is limited by other elements of the lamp circuit, such as ballast coil resistance and lamp filament resistance. The values for $B_r$ and $H_r$ are generally proportional for various desired current levels within the substantially linear portion of the permeability curve, but the valves of $B_s$ and $H_s$ are not proportional to $B_r$ and $H_r$ as in prior art ballasts.

Figure 6:
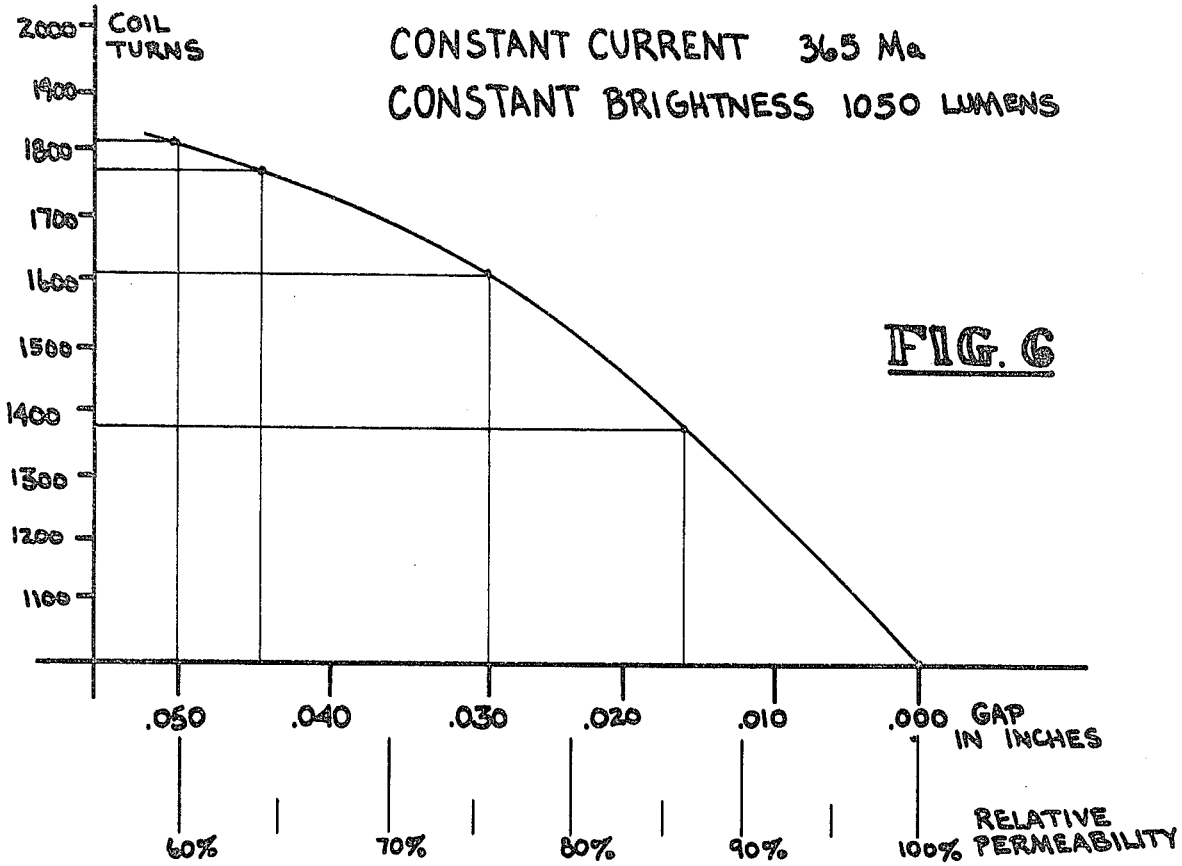
FIG. 6 is a graphical representation showing the range of relative permeability for one level of lamp current and lamp brightness.

FIG. 6 illustrates the relationship between an inductor ballast core and coil which will permit the design of a ballast to produce a single, specific lamp current and attendant lumen output at various levels of relative core permeability. To maintain consistency in this disclosure, a ballast of approximately 365 Ma is illustrated, which produces the lumen output of 1050 lumens from a nominal 22 watt circline lamp. In the data shown a ½ inch square EI lamination core is wound with AWG 32 copper wire. Every point on the curve for relative permeability produces a ballast with a lamp operating current of 365 Ma. It is well known that relative permeability of an inductive core may be adjusted by varying the width of a gap in the magnetic path. If the gap is zero, the relative permeability is 100%. If the gap is very wide, at about the practical limit shown of 0.050 inch, the relative permeability may be reduced to 60%. A gap in an inductor core is normally provided in order to increase inductor current without saturation of the core. Therefore the current level at the point where saturation begins may be varied by simultaneously varying the core gap and the number of turns in the coil. In the data of FIG. 6 it may be seen that using the core size, wire size and operating current as constants, that 365 Ma may be provided with an inductor having 1800 turns in the coil and 0.045 inches gap in the core, and the relative permeability will be 64%. An identical operating current can be produced by an inductor having 1600 turns an 0.030 inch gap, and the relative permeability will be 77%. The same current will be produced by an inductor with 1375 turns an 0.016 inch gap, and the relative permeability will be 87%. With a 1000 turn coil and zero gap, the relative permeability will be 100%, but control of current is lost for the core becomes saturated at less than 365 Ma. Therefore a larger core would have to be selected if a relative permeability near 100% were needed to provide inductor operation at a point just short of saturation at 365 Ma.

Figure 7:
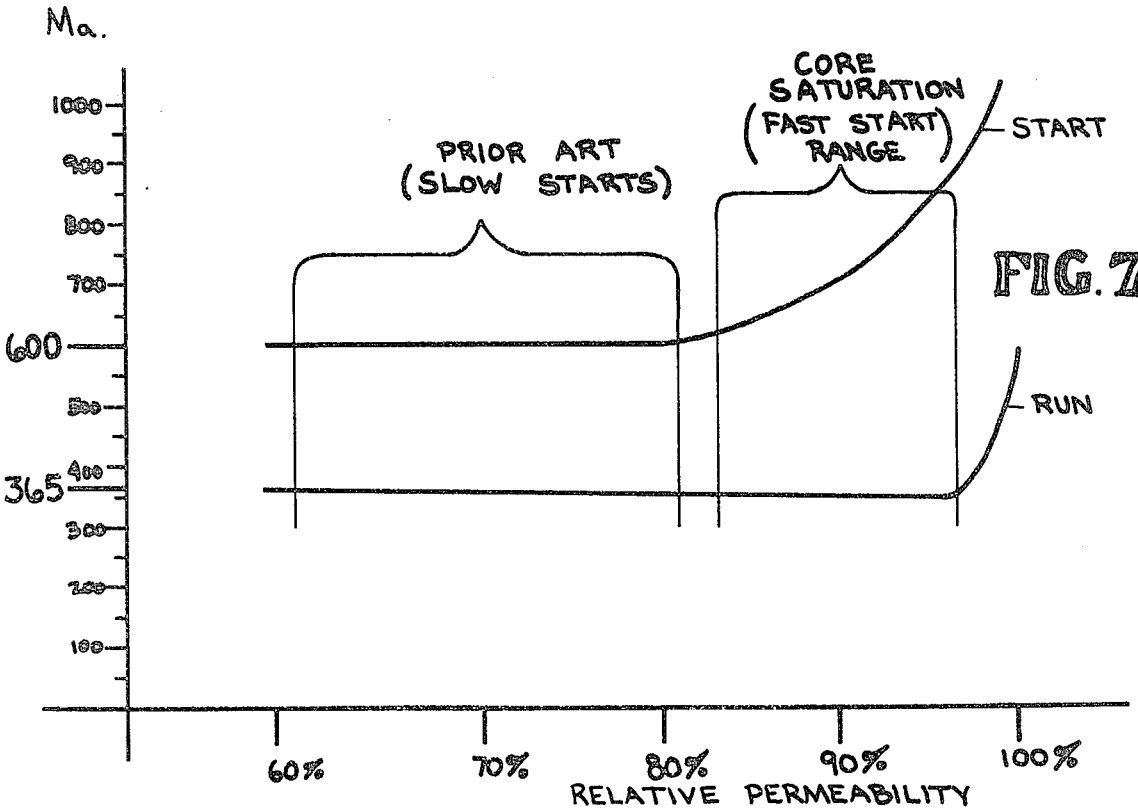
FIG. 7 shows the relationship between starting current and running current for the relative permeability range covered by prior art ballasts and the ballasts of FIG. 1.

In FIG. 7 the relationship between lamp operating current and lamp starting current as a function of relative permeability may be seen. As seen in FIG. 6, relative permeability at or near 100% indicates the core is very near saturation at even low current levels. Conversely, relative permeability near 60% indicates that the core is operating in the very linear range of its BH curve, and is far from saturation at relatively high current levels. With the same 22 watt lamp example having a nominal operating current of 365 Ma for a high impedance running mode of the lamp, the low impedance starting mode would cause more current flow through the ballast coil. This would increase magnetizing force as shown in FIG. 5, and the inductor would limit in an inverse relationship to the lamp impedance. In FIG. 7 if a ballast was designed for 60% relative permeability the starting current for this example will be 600 Ma as shown. If the ballast were designed for an 80% relative permeability (according to FIG. 6, 1500 turns and 0.025 inch gap) 365 Ma operating current would be obtained with the same 600 Ma starting current, with the core approaching saturation for the starting mode only. If the relative permeability of the ballast is changed to 90% the operating current remains 365 Ma, because that current level is not approaching saturation. However, the lower lamp impedance in the starting mode results in greater coil current. This brings the core induction further up the BH curve as shown in FIG. 5, where it requires greater change in magnetizing force (ampere turns) to incrementally increase induction. Therefore the ballast with 90% relative permeability as shown in FIG. 7 will have a starting current of 700 Ma with the same 365 Ma operating current as those ballasts with lower relative permeability. Such a ballast will provide the lamp with the same current and brightness, but will start much more quickly and easily on 700 Ma than 600 Ma.

It has been the practice in prior art ballasts to operate the cores at relative permeabilities of from 60% to 80% to keep the cores operating in the most linear range of the BH curves for the laminations used. This has permitted the use of less expensive lamination steel, but at the same time has required more weight of both laminations and copper wire for the coil. The present invention operates in the range of 82% to 95% relative permeability, requiring more expensive lamination steel to avoid thermal problems, but using much less weight of both laminations and copper wire.

Figure 8:
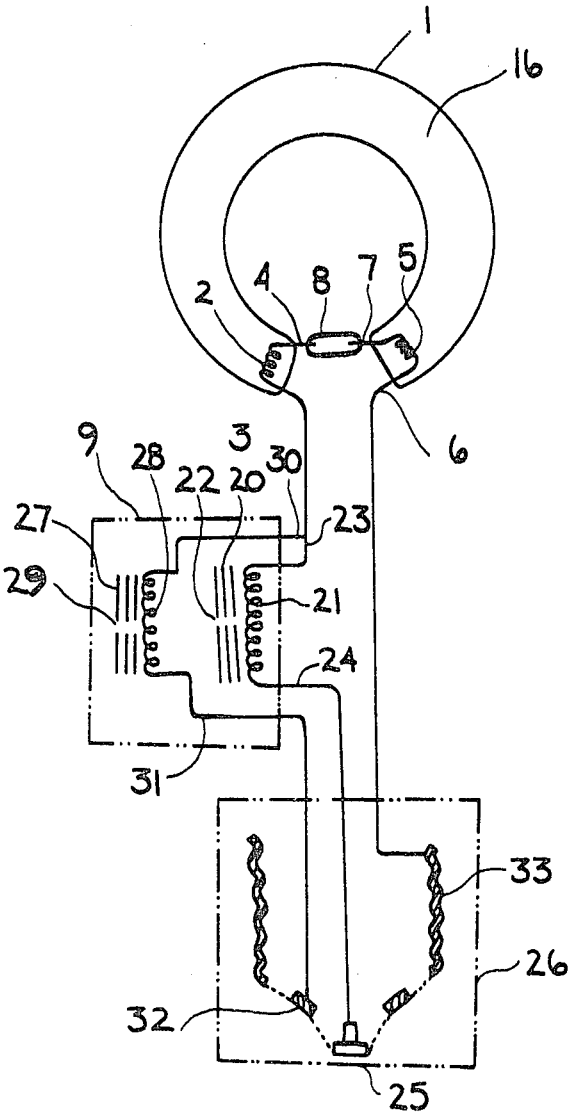
FIG. 8 is a schematic diagram of the circuit of FIG. 1, in which the ballast comprises two inductors in a three-way switched arrangement.

FIG. 8 shows a schematic diagram of a method for starting and operating a preheat type fluorescent lamp from a three-way socket in which a fluorescent lamp 1 has a first filament 2 which is provided with a first connection lead 3 and a second connection lead 4, and a second filament 5 which is provided with a first connection lead 6 and a second connection lead 7. A starting switch 8 is connected between lead 4 and lead 7. A core-and-coil inductor ballast 9 is provided with a first magnetically permeable core 20 and a current carrying coil 21. The core 20 is provided with at least one non-magnetic gap 22 of appropriate width to alter the permeability of core 20. Coil 21 has a first lead 23 connected to filament lead 3, and a second lead 24 connected to the center contact 25 of a three-way male screw base 26. Ballast 9 is also provided with a second magnetically permeable core 27 and a second current carrying coil 28. Core 27 is provided with at least one non-magnetic gap 29 of appropriate width to alter the permeability of core 27. Coil 28 has a first lead 30 connected to filament lead 3 and a second lead 31 connected to the intermediate ring contact 32 of screw base 26. Filament lead 6 is connected to the screw shell 33 of male screw base 26.

The operation of the circuit is substantially the same as that described and shown in FIG. 1, however in FIG. 8 either or both core-and-coil inductors in the ballast will operated in a saturated mode for lamp starting, and either or both core-and-coil inductors will operate in a non-saturated mode for lamp operation, when the appropriate contacts of screw base 26 are electrically energized by a three-way switching means.

Using the method of this invention, the inventor has fabricated ballasts meeting required operating current specifications, and having greatly improved starting characteristics, lower temperature range, wider current and brightness range with good starting, longer lamp life, longer starter life, and lower cost construction through the use of less than half the weight of laminations and copper when compared to prior art ballasts.

For clarity of disclosure only one lamp type has been used as an example thoughout this specification. However, the principles of the invention apply to preheat lamps of all sizes and types from 4 watt through 40 watt, and including straight lamps, U-lamps, circline lamps and a variety of special tube configurations.

I claim:

1. A method for starting and operating a preheat type fluorescent lamp in which the lamp has a first lower impedance starting mode providing current flow through at least one lamp filament operated in series with a starting switch means from an electrical power source, a second higher impedance operating mode providing current flow through the lamp with said starting switch open, and a series saturable magnetically permeable core-and coil inductor for limiting current flow through the lamp in which the improvement comprises:

passing current from the starting switch means through said coil-core inductor at a level to provide (a) operation of the magnetically permeable core of the core-and-coil inductor in a substantially saturated condition when the lamp is in the lower impedance starting mode; and (b) operation of the magnetically permeable core of the core-and-coil inductor in a non-saturated condition when the lamp is in the higher impedance operating mode.

2. A method for starting and operating a preheat type fluorescent lamp as in claim 1 in which the starting current is at least 70% greater than the lamp operating current.

3. A method for starting and operating a preheat type fluorescent lamp as in claim 1 in which the lamp operating circuit is no greater than 75% of the nominal rated lamp operating current.

4. A method for starting and operating a preheat type fluorescent lamp as in claim 1 in which the lamp current is supplied from a three-way electrically switched power source and wherein the ballast comprises two inductors operated singly or in parallel, either or both inductors being capable of starting the lamp in a saturated core operating mode and operating the lamp in a non-saturated core operating mode.

5. A method for starting and operating a preheat type fluorescent lamp as in claim 4, in which a first inductor operates the lamp at approximately 50% of its nominal rated current, a second inductor operates the lamp approximately at its nominal rated current and both inductors operate the lamp at approximately 150% of nominal rated lamp current.

6. A method for starting and operating a preheat type fluorescent lamp as in claim 1 in which the inductor controls the lamp current primarily by inductive means when the lamp is in the operating mode and primarily by resistive means in series with one or more lamp filaments when the lamp is in the starting mode.

7. A method for starting and operating a preheat type fluorescent lamp as in claim 1 in which the core-and-coil inductor has a relative permeability greater than 82%.

* * * * *